United States Patent [19]

Hayakawa et al.

[11] Patent Number: 4,928,210

[45] Date of Patent: May 22, 1990

[54] LINEAR LAMP UNIT WITH CONTACTS AT BOTH ENDS

[75] Inventors: Futomi Hayakawa; Kazuo Onoda, both of Tokyo, Japan

[73] Assignee: Kabushiki Kaisha Hybec, Tokyo, Japan

[21] Appl. No.: 396,629

[22] Filed: Aug. 18, 1989

Related U.S. Application Data

[63] Continuation of Ser. No. 140,560, Dec. 30, 1987, abandoned.

[30] Foreign Application Priority Data

May 29, 1987 [JP] Japan ..... 62-134037

[51] Int. Cl.[5] ..... H01J 5/50

[52] U.S. Cl. ..... 362/217; 362/226; 439/612; 313/318

[58] Field of Search ..... 362/217, 226, 382; 439/611, 612; 313/318, 51

[56] References Cited

U.S. PATENT DOCUMENTS

| | | | |
|---|---|---|---|
| 940,021 | 11/1909 | Howard et al. | 313/318 |
| 1,802,167 | 4/1931 | Blank | 439/612 |
| 2,187,011 | 1/1940 | Braden | 62/285 |
| 2,886,629 | 5/1959 | Van Geel | 313/318 |
| 3,265,923 | 8/1966 | Preziosi et al. | 439/612 |
| 3,267,275 | 8/1966 | Kendall et al. | 313/318 |
| 3,320,466 | 5/1967 | Ayers et al. | 439/612 |
| 3,360,765 | 12/1967 | Strange et al. | 439/612 |
| 3,862,397 | 1/1975 | Anderson et al. | 219/405 |
| 3,961,216 | 6/1976 | Edwards | 439/612 |
| 4,322,783 | 3/1982 | Chappell et al. | 313/318 |
| 4,404,491 | 9/1983 | Siaens et al. | 313/318 |

FOREIGN PATENT DOCUMENTS

| | | | |
|---|---|---|---|
| 1380237 | 10/1964 | France | 313/318 |

*Primary Examiner*—Ira S. Lazarus
*Assistant Examiner*—Richard R. Cole
*Attorney, Agent, or Firm*—Young & Thompson

[57] ABSTRACT

An elongated lamp unit in which electrically conductive connecting terminals provided at both ends of the lamp are electrically connected by force fitting into metal contact clamps arranged opposite each other. The electrically conductive connecting terminals extend endwise beyond flat portions formed on each end of an elongated lamp bulb and are electrically connected with a filament disposed in the bulb, and have surface-to-surface contact with the metal contact clamps. The metal contact clamps which receive the electrically conductive connecting terminals are connected with a power supply and comprise a pair of electrically conductive metal pieces opposite each other, these metal pieces having upper ends defining an insertion opening portion which receives the electrically conductive connecting terminal and limits at an inner portion of the electrically conductive contact the inserted position of the electrically conductive connecting terminal.

6 Claims, 8 Drawing Sheets

LINEAR LAMP UNIT WITH CONTACTS AT BOTH ENDS

This application is a continuation of application Ser. No. 140,560, filed 12/30/87 now abandoned.

BRIEF DESCRIPTION OF THE INVENTION

The present invention relates to a linear lamp unit with contacts at both ends, which is useful for outdoor illumination or for work operations using radiant heat or for various other applications.

PRIOR ART

It is known to use halogen lamps which have high brightness and are arranged in line, in various fields. The halogen lamp itself can have various structures. For example, in the halogen lamps arranged in line as described in U.S. Pat. No. 3,862,397, a filament is arranged in a bulb, both end portions of the bulb, in the longitudinal direction of the filament, being drawn from flat portions formed when sealing both end portions of the bulb. Then, the aforesaid flat portions are inserted into and connected to metal contact clamps.

Furthermore, in such a prior art lamp unit, for example as illustrated in FIGS. 1 and 2 of the drawings of the present application, a metal contact mounted on a casing of an illuminating device is provided with a head 2 and a relatively long leg portion 3. The head 2 forms a U-shaped insert slot 4 extending in the direction of the leg portion 3 from an upper end thereof. To a fixing portion 6 of the leg portion 3 is fixed a lower end of a terminal plate 5 connected with a power supply by means of a rivet 7. On an upper end of the terminal plate 5 is fixed a convex terminal 8. The lamp arranged in line and removably disposed between a pair of the metal contacts has secured at each end thereof a longitudinally extending connector 11. A portion of each connector 11 is embedded in a flat portion 90 comprising a flattened end of the bulb 9.

The connector 11 protruding from the flat portion 90 is connected with a terminal (not shown) embedded in a ceramic cylinder 12. The outer end of each ceramic cylinder 12 is formed with a recess 13. The filament 10 is in electrical contact with the terminal 8 engaged in the recess 13. For this purpose, the filament 10 extends through ceramic cylinder 12 and terminates in recess 13.

In the ceramic cylinder 12 is formed a slot 14 into which the flat portion 90 is fitted and fixed with adhesive. A cover portion 20 of the head 2 is provided for safety so that the connection between the terminal 8 and the recess 13 is not directly exposed by the slot 4.

Furthermore, in another known lamp unit shown in FIGS. 3 and 4 of the present drawings, a metal contact 1 is provided with a hollow casing 21 into which an insulating sleeve 22 is inserted. In the insulating sleeve 22 is formed a recess portion 23 in which a head 24 is slidably inserted. To the head 24 is fixed a terminal 25 which is capable of sliding in the insulating sleeve 22. Reference numeral 26 shows a spring and reference numeral 27 shows as outer cover. Reference numeral 28 shows a lead wire which is connected to the head 24 one hand and to the power supply on the other hand.

PROBLEM TO BE SOLVED BY THE INVENTION

In the linear lamp disclosed in the aforesaid U.S. patent, the flat end portion of the bulb is force fitted into the metal contact clamp. Because the filament of thin diameter is located on a surface of the flat portion, the filament can be abraded by sliding against the inner surface of the metal contact clamp until it wears out. Also because there is only line contact between the filament and the clamp after force fitting of the flat portion, if the fit becomes somewhat loose, the contact can be broken, or at least it lacks reliability.

Furthermore, because the metal contact clamp has no positive positioning means for defining a fully inserted lamp position, the lamp has different positions every time it is inserted and therefore it is difficult to keep the distance between the lamp and an associated reflecting surface constant. Still furthermore, in the lamp unit shown in FIGS. 1 and 2 of the present drawings, the metal contact has a head and a leg portion and the terminal plate must be of relatively long length. Accordingly, since the distance "A" shown in FIG. 2, between the terminal and the end of the leg portion, is large, the metal contact is necessarily large in size.

Also, in the manufacture of such a lamp, if the ceramic is fixed to the bulb even slightly askew and the bulb is mounted on the metal contact, the bulb will be mounted askew on the metal contact. Accordingly, the longitudinal axis of the bulb will not be horizontal, and a uniform length of beam will not be obtained between the axis of the bulb and an object to be illuminated or heated over all of the length of the bulb. Moreover, the task of attaching the ceramic properly to the flat portion with adhesive is difficult.

Finally, in the lamp unit shown in present FIGS. 3 and 4, because the terminal is capable of sliding in the insulating sleeve under the influence of the spring, the length "B" along the axis of the metal contact is long, whereby the latter is large in size.

OBJECTS OF THE INVENTION

It is an object of the present invention to provide a lamp unit in which electrically conductive connecting terminals of lamps are disposed outside a blocking portion formed at both ends of a bulb and are electrically connected with a filament arranged in the bulb, and in which the terminals are electrically connected with metal contact clamps arranged opposite the terminals by inserting the latter into the metal contact clamp, over a wide area of surface contact and therefore the connection is obtained with very high reliability.

It is another object of the present invention to provide a lamp unit in which an electrically conductive connecting terminal can be inserted into a metal contact clamp with a single movement and in which the lamp is designed to be positioned at a fixed position upon inserting it, whereby the distance between the bulb and a reflecting surface is kept constant.

DETAILED DESCRIPTION OF THE INVENTION

Figure 1:
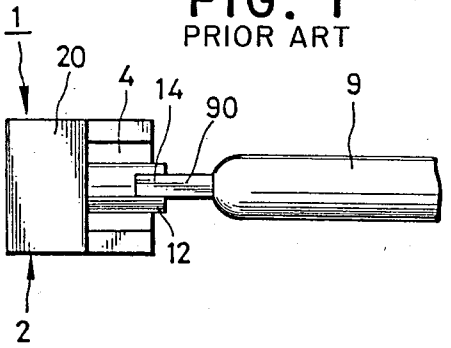
FIG. 1 PRIOR ART
FIG. 1 is a partial plan view showing a prior art lamp unit.
Figure 2:
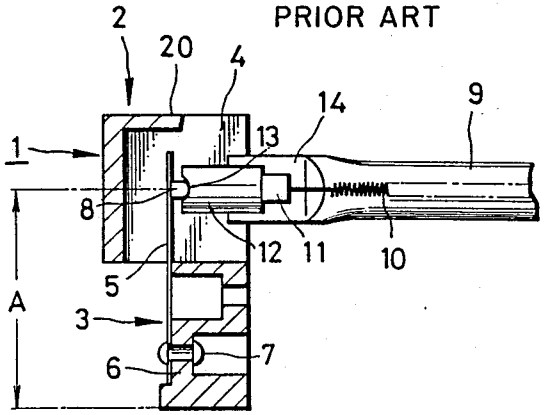
FIG. 2 PRIOR ART
FIG. 2 is a longitudinal cross sectional view of FIG. 1.
Figure 3:
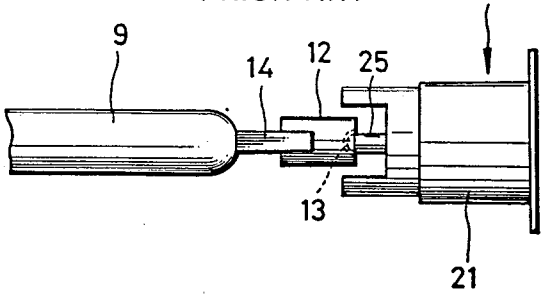
FIG. 3 PRIOR ART
FIG. 3 is a partial plan view showing another lamp unit of the prior art.
Figure 4:
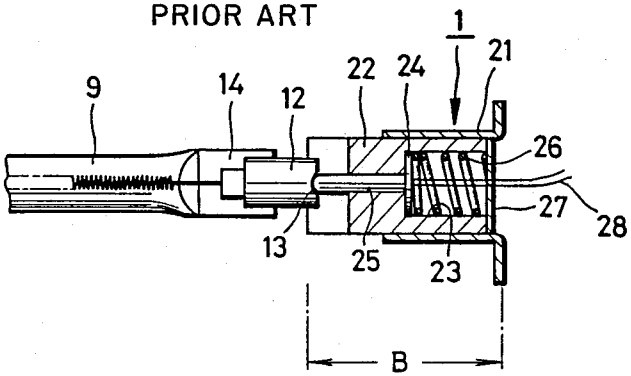
FIG. 4 PRIOR ART
FIG. 4 is a longitudinal cross sectional view of FIG. 3.
Figure 5:
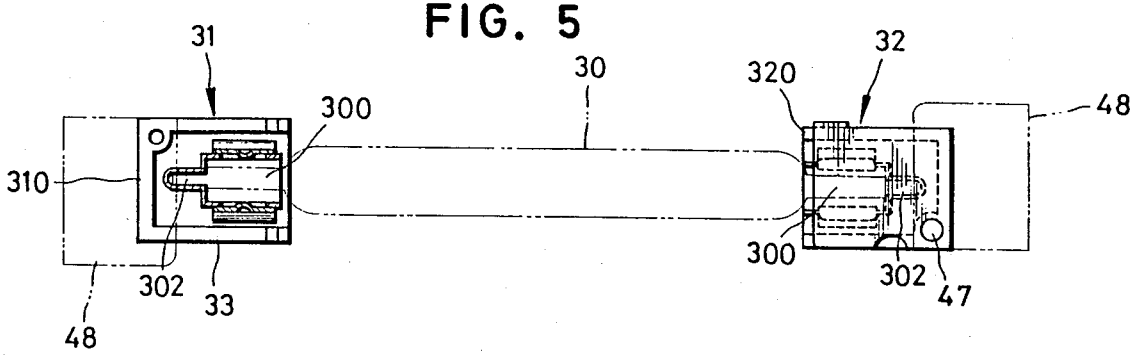
FIG. 5 is a plan view showing one embodiment of a lamp unit according to the present invention.
Figure 6:
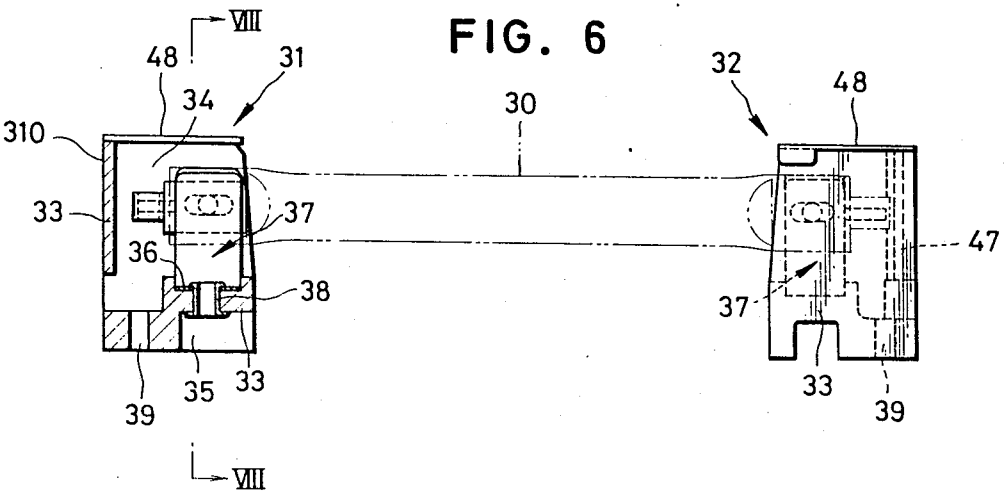
FIG. 6 is a side view of the embodiment of FIG. 5, showing in cross section only the left metal contact clamp.

The embodiments of the present invention shown in the drawings will now be described in detail, but the present invention is not limited to these embodiments.

Referring first to FIGS. 5 to 8, reference numeral 30 is a linear tungsten halogen lamp. Both ends in the direction of the axis of the lamp are electrically and detachably connectible to metal contact clamps 37 arranged in hollow casings 31 and 32. Both metal contact clamps 37 have the same structure and therefore, in the following description, only one of the metal contact clamps 37 need be described.

The hollow casings 31 and 32 are provided with socket bodies 310 and 320. Because they have the same structure, in the following description, only the socket body 310 will be described.

In the socket body 310 is provided a partition wall 33 by which an upper chamber 34 and a lower chamber 35 are formed. A recess 36 is formed on an upper surface of the partition wall 33 in which a bore 38 is provided. In this bore 38 is fixed the metal contact clamp 37 as will be described hereinafter. To the metal contact clamp 37 is connected a lead wire (not shown) introduced through the bore 38, and thereby the metal contact clamp 37 is connected with a power supply. In the socket body 310 is provided a fixing bore 39 by which the socket body 310 is fixed for example, to a casing of an illuminating device by means of a bolt or the like.

Figure 9:
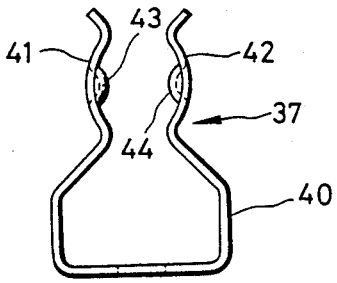
FIG. 9 is a front view showing the metal contact clamp.
Figure 10:
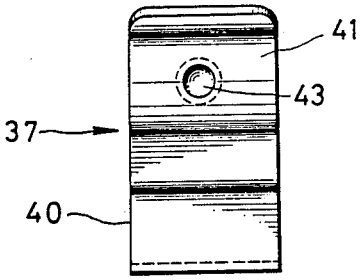
FIG. 10 is a side view of FIG. 9.

The terminal contact clamp 37 is shown in detail in FIGS. 9 and 10 and is formed by bending a sheet of metal plate. The metal contact clamp 37 is provided with a substantially pentagonal base 40. Successively to this base 40 are provided a pair of contacts 41 and 42 opposing each other. Center portions of the contacts 41 and 42 are formed to bulge outwardly. Upper ends of the contacts 41 and 42 bent outwardly away from each other. On inner surfaces of the arcuate portions of the contacts 41 and 42 are fixed convex terminals 43 and 44 facing each other.

Figure 7:
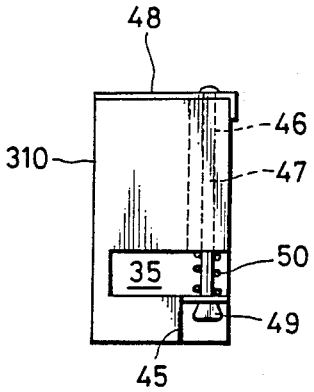
FIG. 7 is an end view showing a casing receiving the metal contact clamp.
Figure 8:
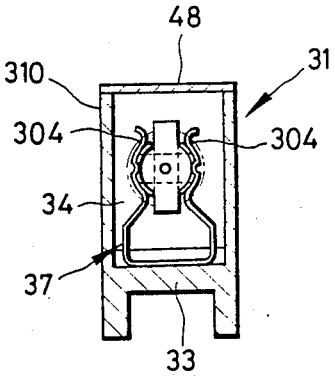
FIG. 8 is a cross sectional view taken along line VIII—VIII of FIG. 6.
Figure 13:
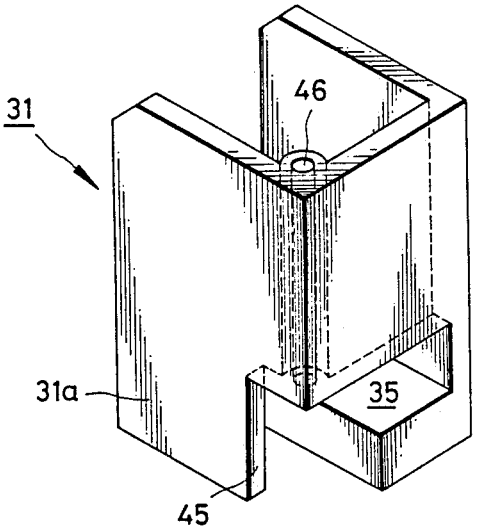
FIG. 13 is a perspective view showing the casing receiving the metal contact lamp, the cover plate being removed.
Figure 14:
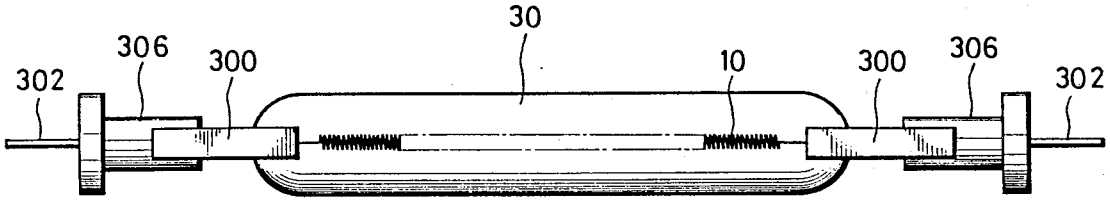
FIGS. 14 to 20 are somewhat schematic views showing different embodiments of the lamp.

The aforesaid chamber 35 is open at the rear thereof (see FIGS. 7 and 13). A corner portion of the opening is formed in the form of a reverse L-shaped cut-out portion 45. A pivot pin 47 passes through a bore 46 provided in a corner portion of the socket body 310, and a cover plate 48 is mounted on an upper end of the pivot pin 47. The cutout portion 45 is provided to make it easy to insert an operator's finger tip when attaching and detaching a nut 49 which serves to fasten a lower end of the pivot pin 47. Reference numerals 50 designates a spring which continuously presses downward the pivot pin 47 in order to force the cover plate 48 into contact with the opening surface. The cover plate 48 serves as a safety measure to shield a connecting portion between a connecting terminal of the lamp 30 and the metal contact clamp 37 from the outside.

Figure 11:
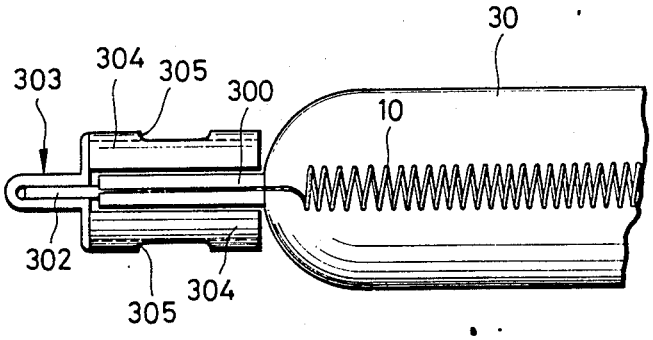
FIG. 11 is an enlarged fragmentary plan view showing an attachment provided on an electrically conductive connecting terminal of the lamp.
Figure 12:
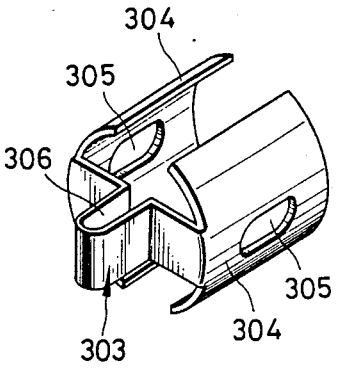
FIG. 12 is a perspective view showing the attachment of FIG. 11.

The lamp 30 is flattened at both ends so as to form flat portions 300. Through the later passes a filament 301 which is connected with a flat connecting terminal 302 embedded in the flat portion 300. The connecting terminal 302 is fitted into a recess 306 of an attachment 303 and is connected integrally with the latter by spot welding (see FIG. 11). As shown in FIG. 12, successively to the recess 306 are formed contacts 304 that oppose each other. The contacts are curved and have positioning slots 305 extending longitudinally thereof. These positioning slots 305 receive the aforesaid terminals 43 and 44, whereby the inserted position of the lamp 30 is always constant.

Accordingly, the insertion of the lamp 30 may be performed by inserting the contacts 304 provided on both end portions of the lamp 30 so that they snap in from the upper opening portions of the metal clamps 37 and by fitting the terminals 43 and 44 into the positioning slots 305. In this manner, the centering of the axis of the lamp 30 is very simply performed. Also, the electrically conductive contacts 304 and the metal contact clamps 37 are connected over a large contact area whereby the problem of instability is solved. Furthermore, because the contacts 304 are interposed between the arched portions of the metal contact clamps 37 and the positioning bores 305 receive the terminals 43 and 44 in a locked condition, the clamp 30 is positively positioned.

The aforesaid positioning bores 305 are provided diametrically opposite to each other, but they can alternatively be axially offset from each other. Also, the positioning bores 305 may be provided for only one of the contacts. Naturally, the position of the terminal of the metal contact clamp will be correspondingly different in this latter case.

FIGS. 14 to 20 show various shapes of the lamp 30. In the lamp 30 shown in FIG. 14, the bulb is formed in an oblong circular shape and is flattened at its ends so as to form the flat portions 300 on which ceramic cylinders 306 are mounted. In these ceramic cylinders 306 are embedded portions of the electrically conductive connecting terminals 302. The embedded connecting terminals 302 are connected with the filament 10 of the lamp.

Figure 15:
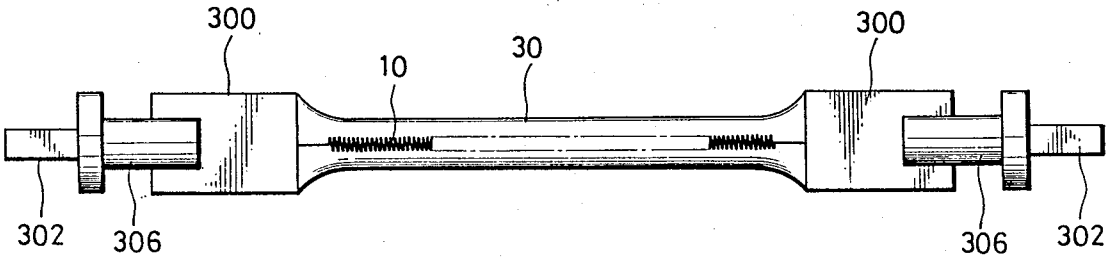

The lamp 30 shown in FIG. 15 is formed to have a thin diameter in a central portion of the bulb.

Figure 16:
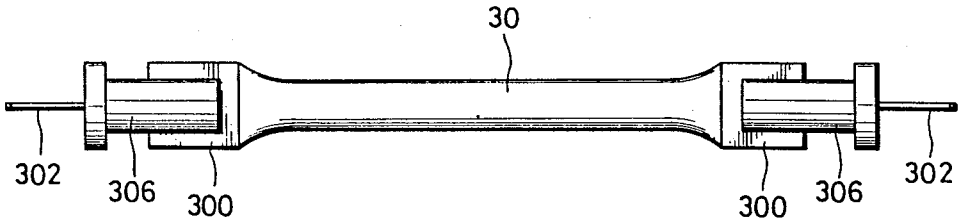
Figure 17:
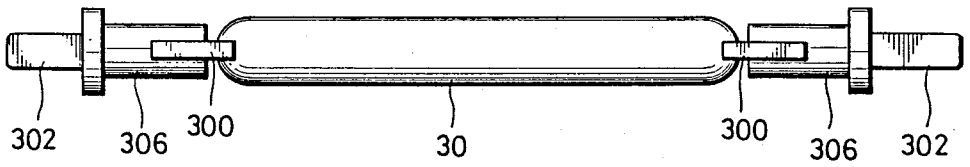

In FIGS. 16 and 17, electrically conductive connecting terminals 302 are embedded 90° to the previously-shown mounting direction of the ceramic cylinders 306 mounted on the flat portions 300. Accordingly, when the lamp 30 is inserted between the metal contact clamps 37, the load occurring during insertion is borne by the mounting portion of the ceramic cylinders 306 whereby there is no danger that the mounting portion will disengage accidentally.

Figure 18:
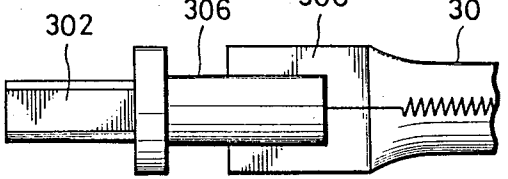
Figure 19:
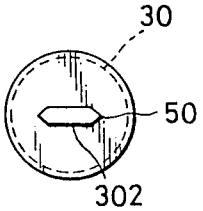

In FIGS. 18 and 19, each electrically conductive connecting terminal 302 is formed in a sharp-edged portion 50 having a V shape in section along both edges thereof. This makes it possible to insert the same smoothly into the metal contact clamp 37.

Figure 20:
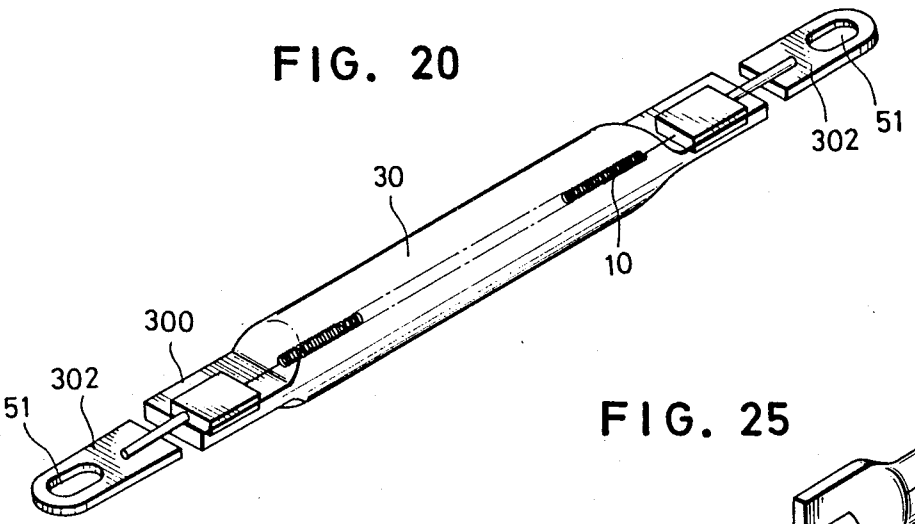

In the lamp 30 shown in FIG. 20, a bore 51 is provided in each of the electrically conductive connecting terminals 302, whereby the lamp 30 can be connected with the power supply side, for example, by utilizing a bolt or the like.

Figure 21:
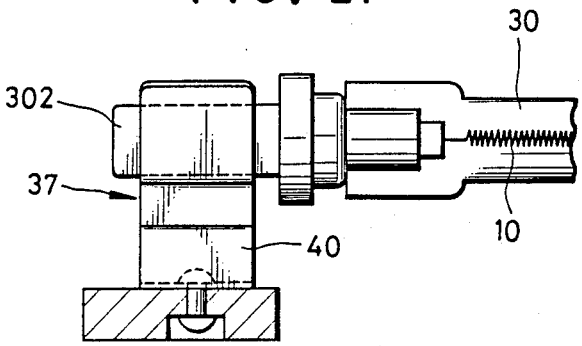
Figure 22:
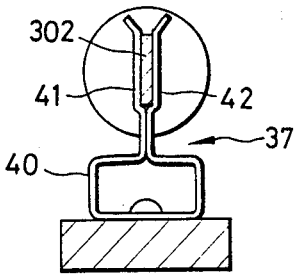

FIGS. 21 to 25 show in detail the other embodiments of the metal contact clamp 37. The embodiment shown in Figs. 21 and 22 is formed by a sheet of metal plate. Successively to the base 40 are provided the contacts 41 and 42, base portions of which are in intimate contact with each other. Between the contacts 41 and 42 is inserted a connecting terminal 302. The upper ends of the contacts 41 and 42 are bent outwardly. The connecting terminal 302 is inserted from above between the contacts 41 and 42. Then, the connecting terminal 302 and the metal contact clamp 37 are connected by their surface contacts. The connecting terminal 302 seats against an inner bottom portion of the clamp 37 and is positively positioned by this portion. The metal contact clamp 37 is fixed to another fixing member.

Figure 23:
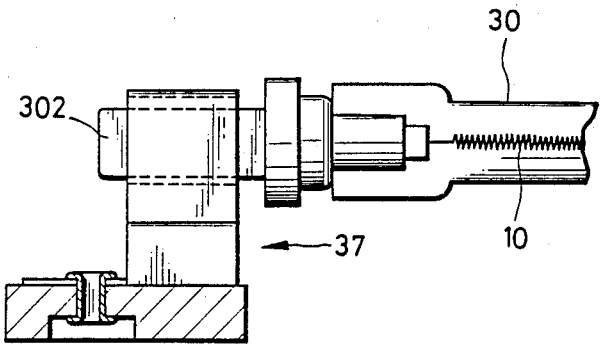
Figure 24:
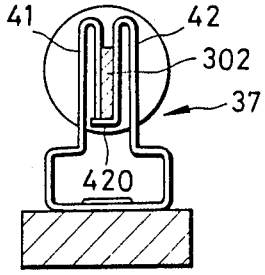

The metal contact clamp 37 shown in FIGS. 23 and 24 differs in respect to the contacts 41 and 42 somewhat from the contact in FIG. 22. In this embodiment, each contact is again formed from a sheet of metal plate. But in this embodiment, the leading ends of the contacts 41 and 42 continuing to the base 40 are folded inwardly in a reversed L shape. An inner end of the contact 42 is bent horizontally at 420, and it leading end is in contact with and is positioned below an inner end of the contact 41.

Figure 25:
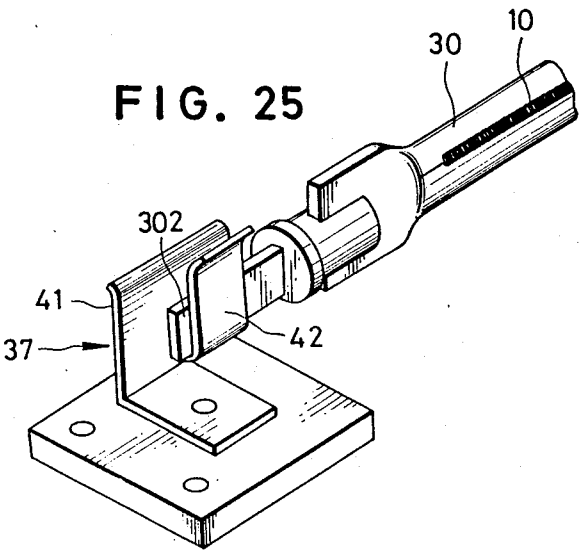
FIGS. 21 to 25 are somewhat schematic views showing different embodiments of the metal contact of the lamp.

Finally, the metal contact clamp shown in FIG. 25 is formed by bending a sheet of metal plate in an L shape. The contacts 41 and 42 are formed by providing a cut in one flange and by bending this cut portion to face the other or upright flange. The positioning of the connecting terminal 302 is performed by forcing it down between the bent portion and the upright flange.

What is claimed is:

1. In an elongated lamp unit in which electrically conductive connecting terminals provided at both ends of the lamp are electrically connected by force fitting into metal contact clamps arranged opposite each other; the improvement in which said electrically conductive connecting terminals are flat metal plated embedded in and extending endwise beyond ceramic cylinders secured to flat portions formed on each end of an elongated lamp bulb, said ceramic cylinders having a diameter less than the width of said flat portions, said terminals being electrically connected with a filament disposed in the bulb, said terminals having surface-to-surface contact with said metal contact clamps on opposite sides of each of said terminals endwise beyond said flat portions.

2. A lamp unit according to claim 1, in which said metal contact clamps which receive said electrically conductive connecting terminals are connected with a power supply and comprise a pair of electrically conductive metal pieces opposite each other, these metal pieces having upper ends defining an insertion opening portion which receives said electrically conductive connecting terminal, and limit means located at an inner portion of the electrically conductive contact to define the inserted position of said electrically conductive connecting terminal.

3. A lamp unit according to claim 2, in which said limit means is a head formed by intimately contacting the contacts opposing each other.

4. A lamp unit according to claim 2, in which said limit means are a bent portion of one of said pair of electrically conductive contacts forming a substantially U shape in section with the other electrically conductive contact whereby said contacts oppose each other.

5. A lamp unit according to claim 1, in which both opposite side edges of said electrically conductive connecting terminal are sharpened.

6. The lamp unit according to claim 1, in which said plates are at right angles to said flat portions of the bulb.

* * * * *